US006386924B2

(12) United States Patent
Long

(10) Patent No.: US 6,386,924 B2
(45) **Date of Patent: *May 14, 2002**

(54) CONNECTOR ASSEMBLY WITH STABILIZED MODULES

(75) Inventor: Michael D. Long, Harrisburg, PA (US)

(73) Assignee: Tyco Electronics Corporation, Middletown, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/541,015

(22) Filed: Mar. 31, 2000

(51) Int. Cl.[7] ..... H01R 13/648
(52) U.S. Cl. ..... 439/701; 439/607
(58) Field of Search ..... 439/701, 79, 607, 439/532, 540.1, 608, 716, 717, 718, 680, 681, 108, 609

(56) References Cited

U.S. PATENT DOCUMENTS

| | | | | | |
|---|---|---|---|---|---|
| 4,900,274 | A | * | 2/1990 | Dorleans et al. | 439/680 |
| 5,286,212 | A | | 2/1994 | Broeksteeg | 439/108 |
| 5,496,183 | A | | 3/1996 | Soes et al. | 439/79 |
| 5,613,882 | A | * | 3/1997 | Hnatuck et al. | 439/686 |
| 5,702,258 | A | | 12/1997 | Provencher et al. | 439/79 |
| 5,795,191 | A | * | 8/1998 | Preputnick et al. | 439/608 |
| 5,860,816 | A | | 1/1999 | Provencher et al. | 439/79 |
| 6,083,047 | A | * | 7/2000 | Paagman | 439/608 |
| 6,123,586 | A | * | 9/2000 | MacDougall | 439/701 |
| 6,146,202 | A | * | 11/2000 | Ramey et al. | 439/608 |

FOREIGN PATENT DOCUMENTS

| | | | |
|---|---|---|---|
| EP | 0 665 612 A2 | 8/1995 | H01R/23/68 |
| WO | WO 99/09616 | 2/1999 | H01R/13/648 |

* cited by examiner

*Primary Examiner*—Renee Luebke
*Assistant Examiner*—Ross Gushi

(57) ABSTRACT

A connector assembly (100) includes a housing (200) receiving electrical terminals (300) that accompany insulating modules (400). The housing includes a shroud (210) projecting in a rearward direction from the housing (200), the shroud (210) engaging the modules (400). The shroud (210) has flat portions (212A) and notches (212B) in spaced-apart rear edges (212) that interfit with flat surfaces (404A) and projecting wedges (404B) on the modules (400).

17 Claims, 6 Drawing Sheets

CONNECTOR ASSEMBLY WITH STABILIZED MODULES

FIELD OF THE INVENTION

A connector assembly is disclosed as having electrical terminals that accompany insulating modules, and the modules are held in stabilized positions relative to the connector assembly.

BACKGROUND OF THE INVENTION

U.S. Pat. Nos. 5,286,212 and 5,496,183 disclose embodiments of a known connector assembly. The known connector assembly has electrical terminals that accompany insulating modules. Between the modules are ground referenced shield members in the form of thin plates that are held in place by being interlocked with lateral sides of the modules.

In the known connector assembly, the terminals that accompany each insulating module have parallel pins for connection to a circuit board. The terminals have mating ends extending at right angles relative to the pins. The mating ends project from the modules and are received within cavities that extend through an insulating housing. The mating ends extend toward a mating face of the housing, and are adapted for mating connection with mating pins that can be inserted through the mating face and into the cavities.

In the known connector assembly, the modules rely on the terminals being interlocked with the housing to hold the modules side by side with one another. The modules are held somewhat infirmly by the terminals, and are easily moved from their desired alignments.

SUMMARY OF THE INVENTION

The invention arises from a need to hold the modules in stabilized positions. Further, the invention arises from a need to hold the modules in straight alignments as they project from the housing. According to an embodiment, a shroud on a rear of the housing engages the modules and stabilizes them in position. The shroud holds the modules in straight alignments as they project from the housing. The modules are aligned to position the terminals along precise centerline spacings for connection with a corresponding precise pattern of terminal locations on a circuit board. Thereby, the modules no longer need to rely on the terminals being interlocked with the housing to hold the modules in stabilized positions, and to hold the modules along straight alignments relative to the housing.

An embodiment includes, electrical terminals accompanying insulating modules, the modules projecting from a housing, the housing having cavities receiving the terminals, the housing having a shroud projecting in a rearward direction from the housing, and the shroud engaging the modules to hold the modules in stabilized positions and in straight alignments relative to the housing.

According to a further embodiment, latches for holding the shields are in view on rears of the modules, rather than being hidden from view on lateral sides of the modules.

BRIEF DESCRIPTION OF THE DRAWINGS

An embodiment of the invention will now be described, by way of example, with reference to the accompanying drawings, according to which.

DETAILED DESCRIPTION OF A PREFERRED EMBODIMENT

Figure 1:
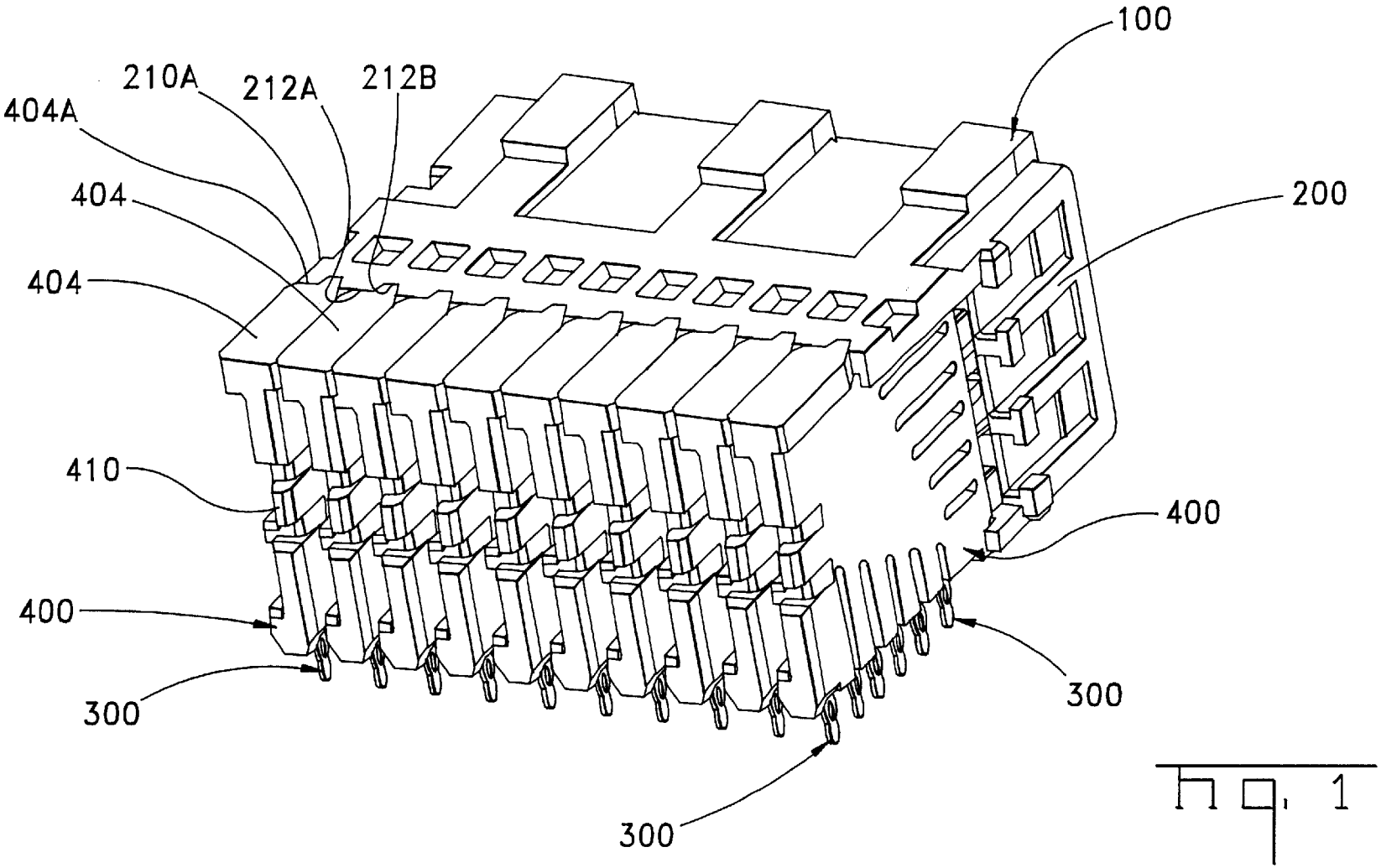
FIG. 1 is an isometric view of a connector assembly having a housing and modules assembled to the housing.
Figure 2A:
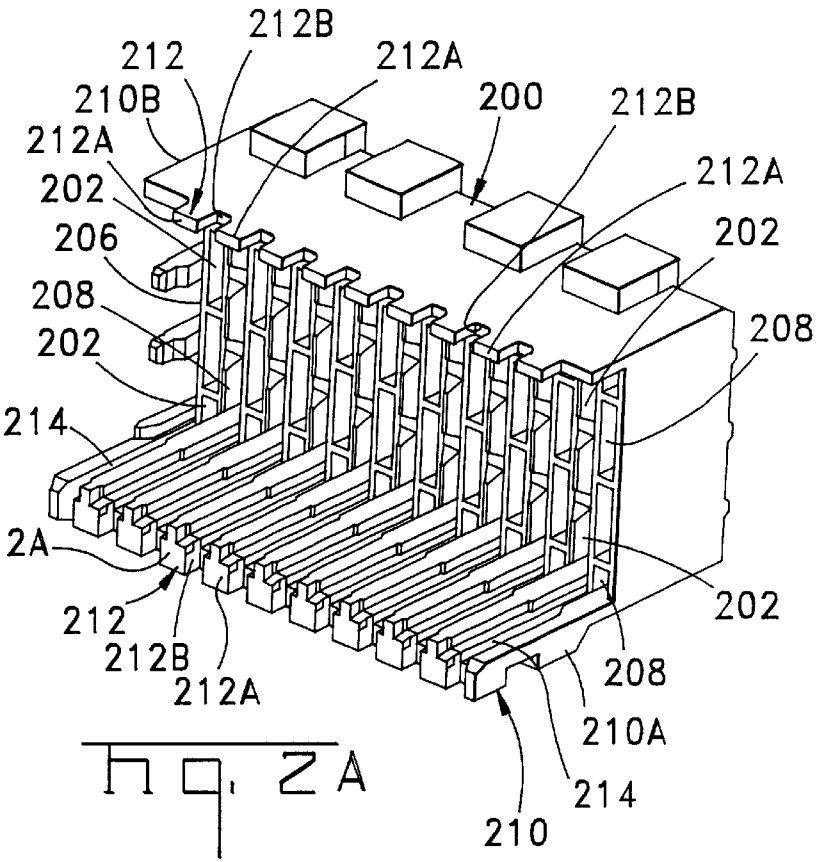
FIG. 2A is an isometric view of a front of the housing, as shown in FIG. 2.
Figure 2:
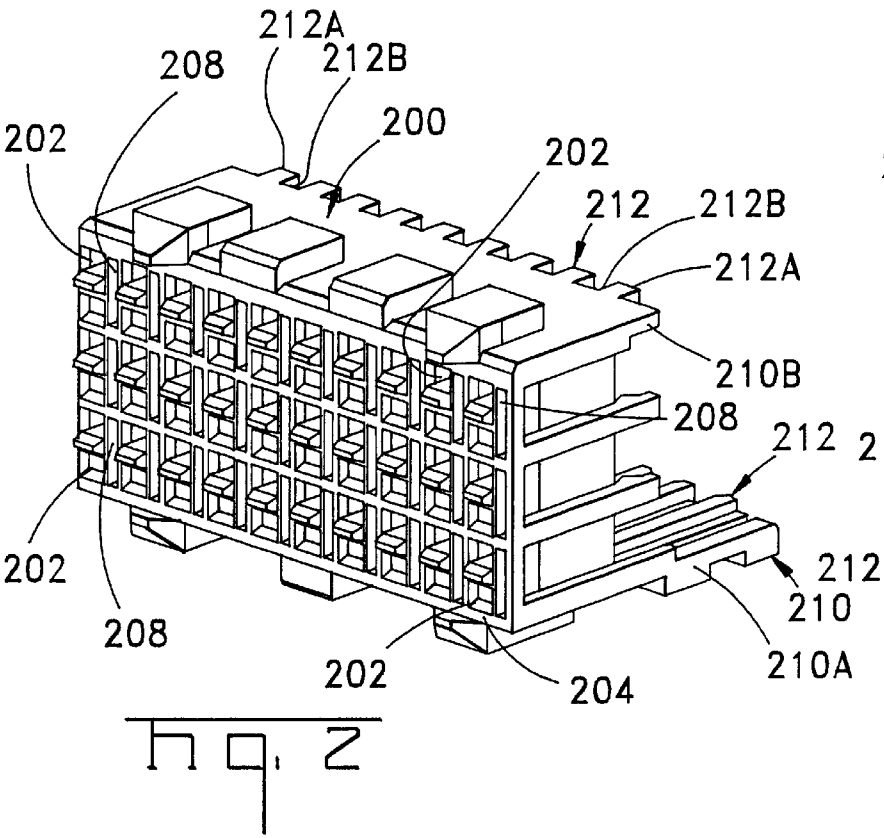
FIG. 2 is an isometric view of a housing, as shown in FIG. 1, and further disclosing a shroud on the housing.

An embodiment of a connector assembly 100 is shown in FIG. 1. The connector assembly 100 has a housing 200 and multiple modules 400 that assemble to the housing 200, and that project from the housing 200 in a rearward direction. As shown in FIGS. 2 and 2A, the housing 200 is made of insulating material, and is of unitary molded construction. Multiple terminal receiving cavities 202 extend through the housing 200 from a front mating end 204 of the housing 200 to a rear 206 of the housing 200. The cavities 202 are arranged in columns. Alternating with the columns of cavities 202 are columns of ground terminal receiving passages 208. The passages 208 extend from the front mating end 204 to the rear 206.

Figure 5:
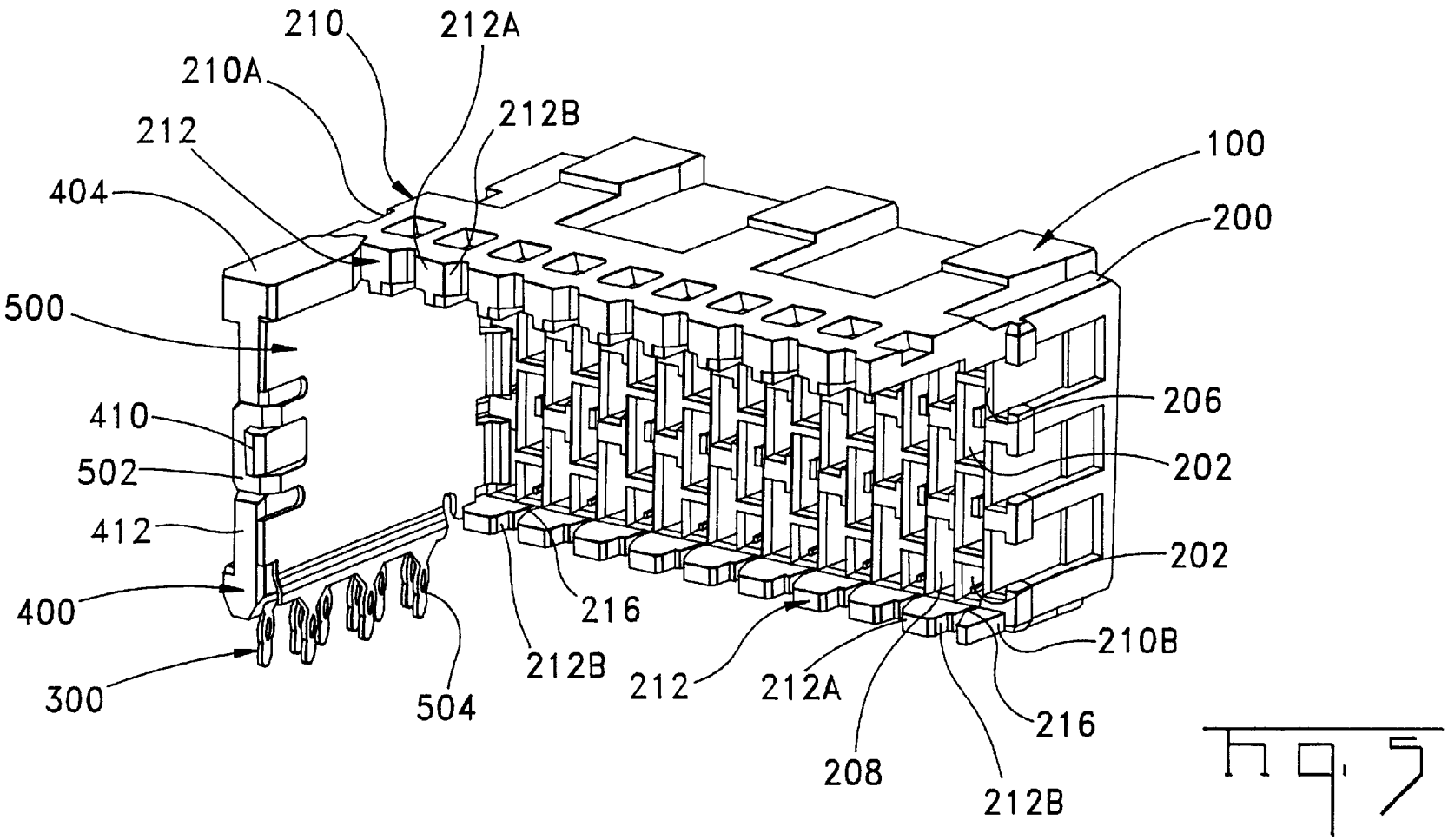
FIG. 5 is an isometric view of the module, as shown in FIG. 3, together with a shield member, prior to being assembled in the housing.

As disclosed in FIGS. 2A and 5, the housing 200 has a bipartite shroud 210 with a first portion 210A and a second portion 210B that are spaced apart in a direction transverse to the rearward direction. The first portion 210A of the bipartite shroud 210 is deeper in the rearward direction than the second portion 210B that is more shallow. The first and second portions 210A and 210B have corresponding, spaced-apart outer edges 212. Because the first portion 210A of the bipartite shroud 210 is deeper than the second portion 210B, the first and second outer edges 212 are offset from each other in a rearward direction. Each of the outer edges 212 has an alternating series of flat portions 212A and truncated V-shaped notches 212B, which engage respective modules 400. As shown in FIG. 2A, the notches 212B in the first portion 210A are aligned with module receiving tracks 214, in the form of grooves, for example, for receiving top edges of the modules 400. FIG. 5 discloses that the second portion 210B has shield member receiving tracks 216, in the form of slots, for example, aligned with the notches 212B.

Figure 3:
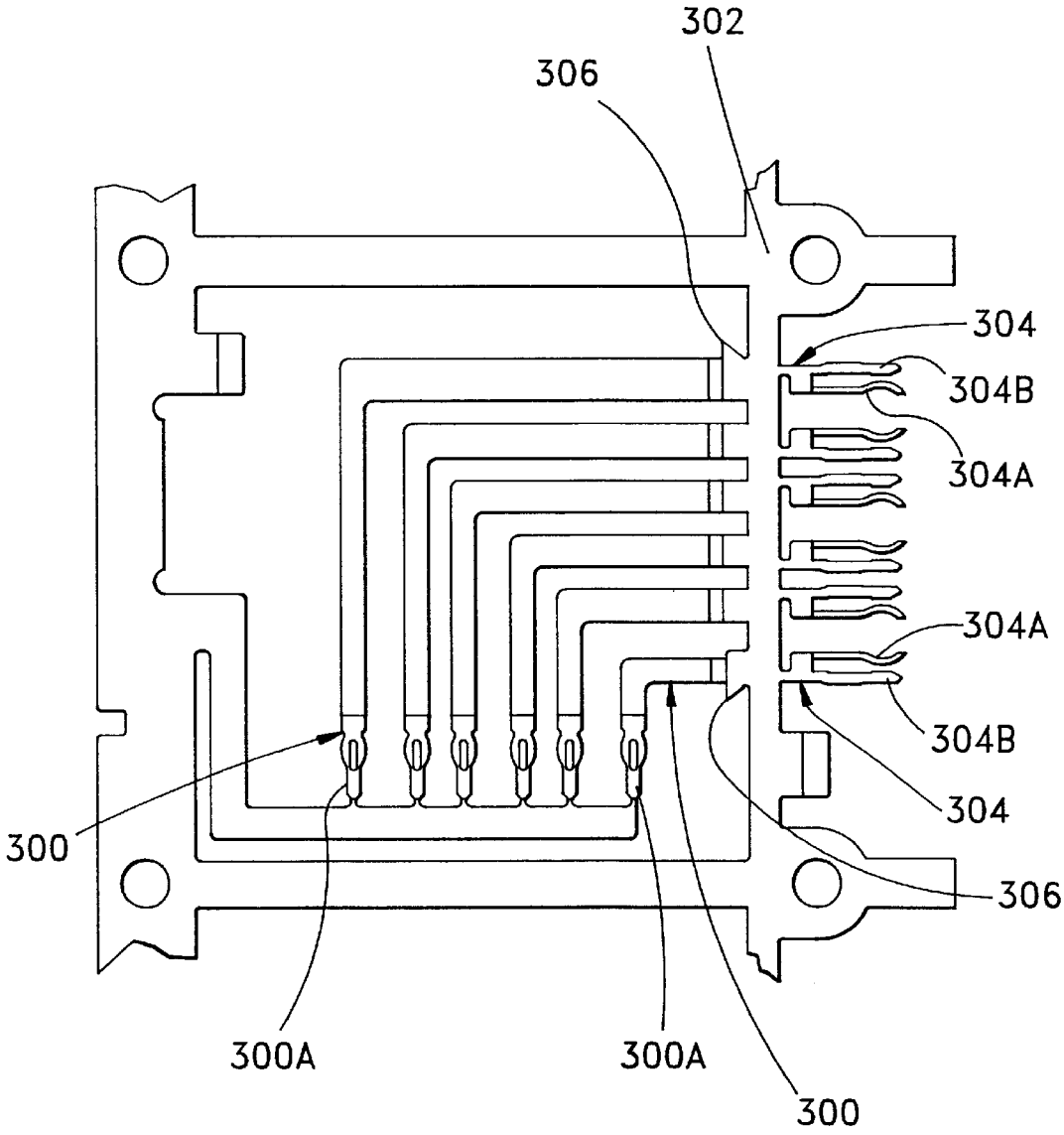
FIG. 3 is a view of electrical terminals that accompany each module, as shown in FIG. 4.

FIG. 3 discloses an array of terminals 300 that accompany each module 400. The terminals 300 are joined to a removable lead frame 302, and are stamped from a strip of metal. The terminals 300 are sheared along their edges that are formed by stamping. The removable lead frame 302 partially encircles the terminals 300. The terminals 300 are joined side to side by the removable lead frame 302. The terminals 300 have parallel pins 300A at first ends. The terminals 300 extend at right angles relative to the pins 300A to mating ends 304.

According to an embodiment, each mating end 304 is an electrical receptacle defined between a pair of resilient spring fingers 304A and 304B. One of the fingers 304A of each pair has its unsheared surface turned ninety degrees to face a sheared edge of the other finger 304B of the pair. Some of the mating ends 304 have rearward projecting barbs 306.

Figure 4:
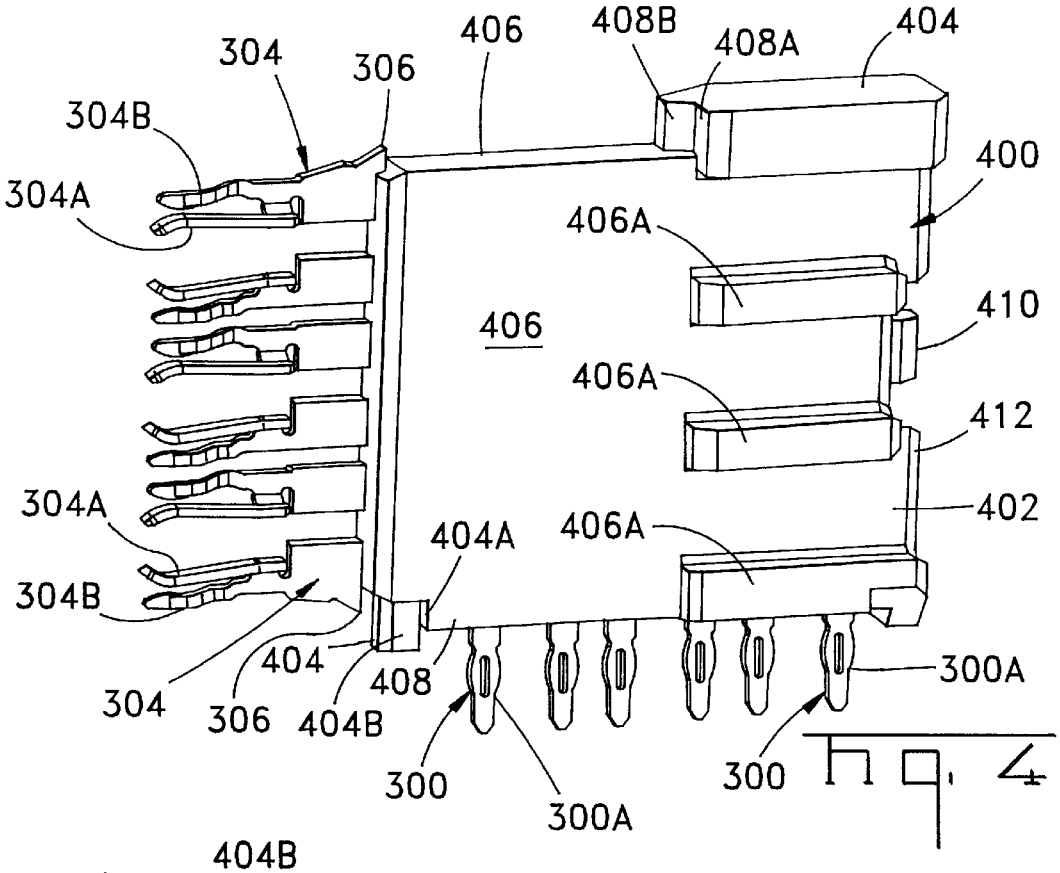
FIG. 4 is an isometric view of one of the modules of the connector assembly, as shown in FIG. 1.
Figure 4A:
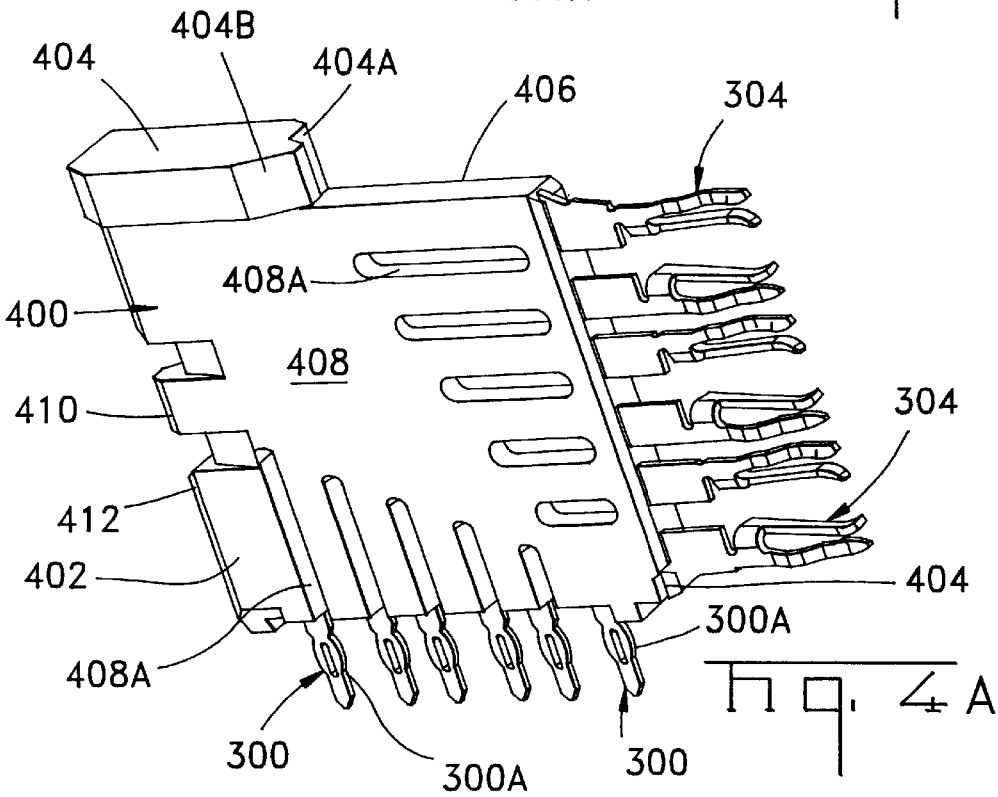
FIG. 4A is an isometric view of the module, as shown in FIG. 3.

With reference to FIGS. 4 and 4A, the terminals 300 accompany each module 400. Each module 400 has an insulating body 402. The insulating body 402 is overmolded, by a known molding process, onto the terminals 300, without being overmolded onto the pins 304A, the mating ends 304 and the lead frame 302. Following the overmolding process, the lead frame 302 is severed and removed from the terminals 300.

The terminals 300 project from a bottom of the insulating body 402, and have the parallel pins 300A for connection to a circuit board. According to an embodiment, the pins 300A are slit to enable narrowing of the pins for compliant fit within apertures of a circuit board.

The mating ends 304 of the terminals 300 project from the insulating body 402 of the module 400. When the module 400 is assembled to the housing 200, the mating ends 304 are received within the cavities 202 that extend through the insulating housing 200. The barbs 306 on some of the mating ends 304 impinge against the interiors of respective cavities 202 to hold the mating ends 304 in the respective cavities 202.

With further reference to FIGS. 4 and 4A, each module 400 has a pair of spaced-apart alignment blocks 404 on the insulating body 402. A top alignment block 404 of the pair is along a top 406 of the module 400, and is spaced-apart from a bottom alignment block 404 of the pair that is along a bottom 408 of the module 400. The alignment block 404 along the bottom 408 of the module 400 is relatively closer to the front of the module 400 than the other alignment block 404. The alignment block 404 along the top 406 of the module 400 is relatively farther rearward from the front of the module 400. Accordingly, the alignment blocks 404 are offset from each other in a rearward direction. A front edge of each alignment block 404 has a flat surface 404A beside a projecting, truncated wedge 404B.

Each module 400 has opposite lateral sides 406 and 408. The lateral side 406 has stand off ribs 406A. The lateral side 408 has air receiving recesses 408A extending between the lengths of the terminals 300, providing a composite dielectric, in part, insulating material, and in part, air, between the terminals 300. The composite dielectric is of lower dielectric constant than that of the insulating body 402 without the air receiving recesses 408A. The alignment blocks 404 project outward laterally from both of the lateral sides 406 and 408. The insulating body 402 has a latch member 410 on a rear 412 of the module 400.

Figure 6:
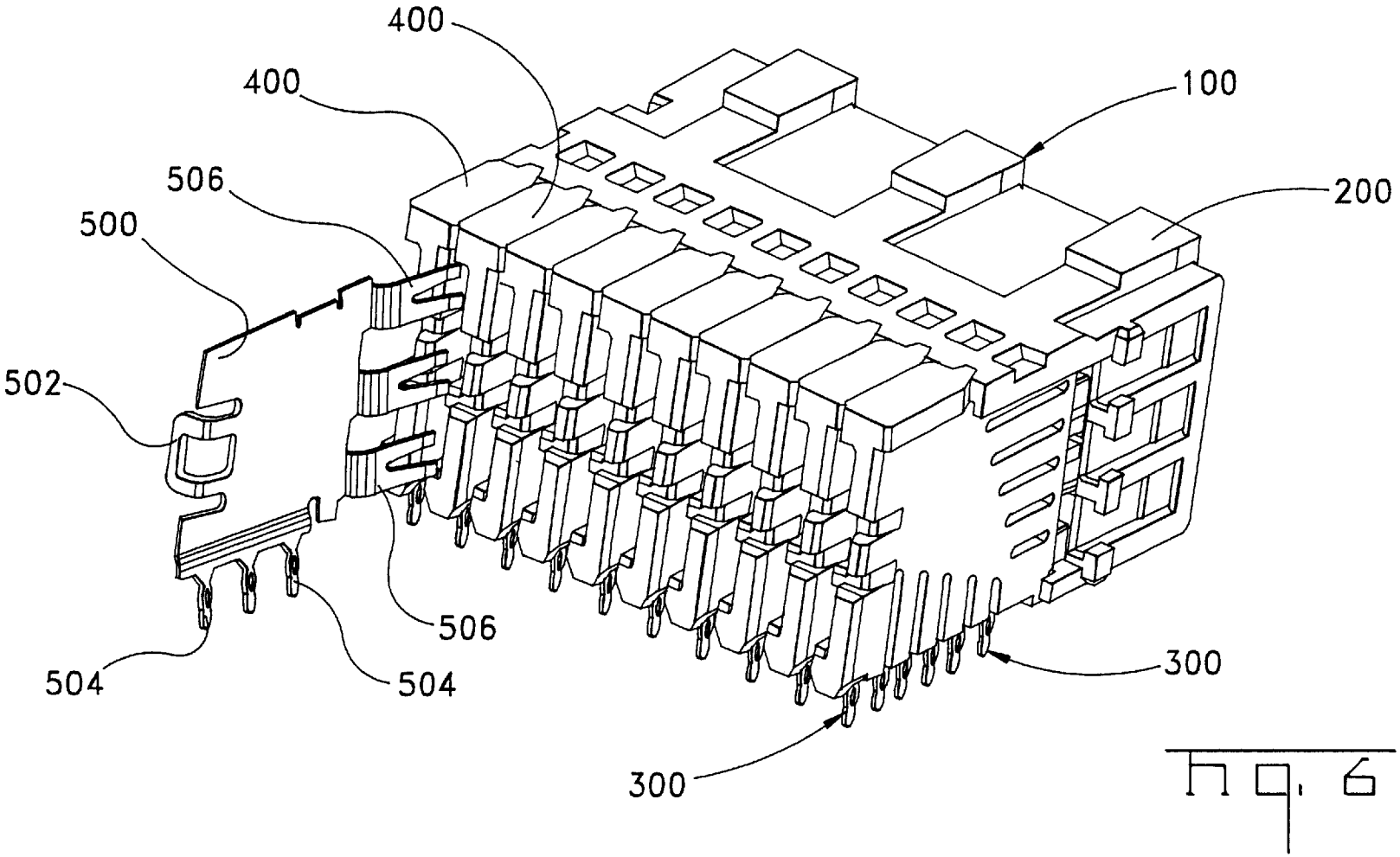
FIG. 6 is an isometric view of the connector assembly, as shown in FIG. 1, and further showing one of a number of shield members in position for assembly laterally beside a corresponding module of the connector assembly.

As further disclosed by FIGS. 1, 5 and 6, each module 400 is assembled with the housing 200. The outer edges 212 of the shroud 210 engage each of the modules 400, which holds each of the modules 400 in a stabilized position and in straight alignment relative to the housing 200. Specifically, the outer edges 212 of the shroud 210, being offset relative to each other in a rearward direction, engage the alignment blocks 404 of each module, and align each module 400 in the rearward direction. The outer edges 212, being spaced apart in a vertical direction, engage the alignment blocks 404 of each module 400, and align each module 400 in the vertical direction that is transverse to the rearward direction. Thus, the modules 400 are aligned to project or extend straight from the housing 200 to position the terminals 300 along precise centerline spacings for connection with a corresponding precise pattern of terminal locations on a circuit board. The top alignment blocks 404 of the modules 400 engage one another side to side, which braces the modules 400 against one another.

The flat portions 212A of the outer edges 212, as well as, the truncated V-shaped notches 212B of the outer edges 212, interfit with each of the modules 400. Specifically, the flat portions 212A interfit with the flat surfaces 404A on the alignment blocks 404 of the modules 400. The truncated V-shaped notches 212B interfit with the projecting truncated wedges 404B on the alignment blocks 404 of the modules 400. Each alignment block 404 has a three point support provided by the flat surfaces 404A and the wedge 404B being interfitted with the outer edges 212. Thus, the shroud 210 interfits with each of the modules 400, whereby the shroud 210 holds the modules 400 in stabilized positions.

As shown in FIG. 5, a ground referenced shield member 500 is received along the lateral side 408 and under the top alignment block 404. A clip 502 is on a rear 504 of the shield member 500. The clip 502 has a loop that receives and latches to the latch member 410. The clip 502 latches to the latch member 410 to hold the shield member 500 in position. FIG. 5 shows that each shield member 500 can be assembled to a module 400, prior to being assembled to the housing 200 together with the module 400.

FIG. 6 discloses the shield member 500 of unitary metal plate construction, with unitary, parallel ground pins 504. According to an embodiment, the ground pins 504 are slit to enable narrowing of the ground pins 504 for compliant fit within apertures of a circuit board. The shield member 500 has unitary ground terminals 506 extending at right angles relative to the ground pins 504. When the shield member 500 is assembled to the housing 200, the ground contacts 506 are received along the passages 208 of the housing 200.

FIG. 6 shows that each shield member 500 is constructed and arranged for assembly to a connector assembly 100. The connector assembly 100 has unshielded modules 400 assembled to the housing 200. To convert the unshielded modules 400 to shielded modules 400, each shield member 500 is easily inserted in a lateral space beside each module 400 of the connector assembly 200. Further, each shield member 500 is removable from the connector assembly 100 for repair and replacement without having to disturb the modules 400 that remain assembled to the housing 200.

Each shield member is easily latched and unlatched with a module 400. The latch 410 and the clip 502 are in view for easy manipulation, to latch them together, or to separate them. Specifically, the latches 410 for holding the shield members 500 are in view on rears 412 of the modules 400, rather than being hidden from view by being on lateral sides 406 and 408 of the modules 400.

Although a preferred embodiment has been disclosed, other embodiments and modifications of the invention are intended to be covered by the spirit and scope of the appended claims.

What is claimed is:

1. A connector assembly comprising:

electrical terminals accompanying insulating modules, a housing having a front mating end and a rear, and cavities receiving mating ends of the terminals through the rear of the housing, the housing having a first shroud projecting in a rearward direction, the first shroud having a rear edge and notches along the rear edge, each of the modules having a forwardly projecting wedge that is interfitted with a respective one of the notches, whereby the first shroud holds the modules in straight alignments relative to the housing, and positions the terminals along precise centerline spacings for connection with a corresponding precise pattern of terminal locations on a circuit board, each of the modules having a rearwardly projecting latch, and shield members each disposed beside a respective one of the modules, each of the shield members having a clip at a rear end thereof, each of the clips being formed as a loop with an opening therethrough, the clips extending laterally along rears of the modules, wherein the clips are engaged with the latches to hold the shield members to the modules.

2. The connector assembly as recited in claim 1, wherein the housing includes a second shroud projecting in the rearward direction, the second shroud has a rear edge and notches along the rear edge, and each of the modules has a forwardly projecting wedge that is interfitted in a respective one of the notches along the rear edge of the second shroud.

3. The connector assembly as recited in claim 2, wherein the rear edges of the first and the second shrouds are spaced-apart from each other in a direction transverse to the rearward direction.

4. The connector assembly as recited in claim 2, wherein the rear edges of the first and the second shrouds are offset from each other in the rearward direction.

5. The connector assembly as recited in claim 2, wherein the rear edges of the first and the second shrouds are offset from each other in the rearward direction, and are spaced-apart from each other in a direction that is transverse to the rearward direction.

6. The connector assembly as recited in claim 1, wherein the rear edge of the first shroud has flat portions disposed in an alternating series with the notches.

7. The connector assembly as recited in claim 1, wherein each of the modules includes an alignment block, and the wedge of each said module projects forwardly from the alignment block of each said module.

8. The connector assembly as recited in claim 7, wherein the alignment blocks on the modules laterally abut one another.

9. A connector assembly comprising:

electrical terminals accompanying insulating modules, a housing having a front mating end and a rear, and cavities receiving mating ends of the terminals through the rear of the housing, the modules projecting from the rear of the housing, the housing having a first shroud projecting in a rearward direction from the housing, the first shroud having a rear edge that is interfitted with the modules to hold the modules in straight alignments relative to the housing, and shield members each disposed beside a respective one of the modules, the shield members having clips at rear ends thereof, each of the clips being formed as a loop with an opening therethrough, the clips extending laterally along rears of the modules, each of the modules having a rearwardly projecting latch that extends through the opening of a respective said clip, wherein the clips are engaged with the latches to hold the shield members to the modules.

10. The connector assembly as recited in claim 9, wherein the housing includes a second shroud projecting in the rearward direction, and the second shroud has a rear edge that is interfitted with the modules.

11. The connector assembly as recited in claim 10, wherein each of the rear edges of the first and the second shrouds has notches that interfit with projecting wedges on the modules.

12. The connector assembly as recited in claim 10, wherein the rear edges of the first and the second shrouds are spaced-apart from each other in a direction that is transverse to the rearward direction, and the edges are offset from each other in the rearward direction.

13. A connector assembly comprising:

electrical terminals accompanying insulating modules, a housing having a front mating end and a rear, and cavities receiving mating ends of the terminals through the rear of the housing, each of the modules having a rearwardly projecting latch, and shield members each disposed beside a respective one of the modules, the shield members having clips at rear ends thereof, each of the clips being formed as a loop with an opening therethrough, the clips extending laterally along rears of the modules, wherein the clips are engaged with the latches to hold the shield members to the modules.

14. The connector assembly as recited in claim 13, wherein the housing has a first shroud projecting in a rearward direction, the first shroud has a rear edge and notches along the rear edge, and each of the modules has a forwardly projecting wedge that is interfitted with a respective one of the notches.

15. The connector assembly as recited in claim 14, wherein the housing has a second shroud projecting in the rearward direction, the second shroud has a rear edge and notches along the rear edge, and each of the modules has a forwardly projecting wedge that is interfitted in a respective one of the notches along the rear edge of the second shroud.

16. The connector assembly as recited in claim 15, wherein the rear edges of the first and the second shrouds are spaced-apart from each other in a direction transverse to the rearward direction.

17. The connector assembly as recited in claim 15, wherein the rear edges of the first and the second shrouds are offset from each other in the rearward direction.

* * * * *